US009335044B2

(12) United States Patent
D'Herville

(10) Patent No.: US 9,335,044 B2
(45) Date of Patent: May 10, 2016

(54) COVER FOR A CHIMNEY

(76) Inventor: Neville Donald D'Herville, Nelson (NZ)

( * ) Notice: Subject to any disclaimer, the term of this patent is extended or adjusted under 35 U.S.C. 154(b) by 1254 days.

(21) Appl. No.: 12/999,108

(22) PCT Filed: Jul. 16, 2009

(86) PCT No.: PCT/NZ2009/000143

§ 371 (c)(1),
(2), (4) Date: Dec. 15, 2010

(87) PCT Pub. No.: WO2010/008305

PCT Pub. Date: Jan. 21, 2010

(65) Prior Publication Data

US 2011/0092147 A1 Apr. 21, 2011

(30) Foreign Application Priority Data

Jul. 16, 2008 (NZ) ..... 569850

(51) Int. Cl.

| | |
|---|---|
| ***E04H 12/28*** | (2006.01) |
| ***F23J 11/00*** | (2006.01) |
| ***F23J 13/08*** | (2006.01) |
| ***F23L 17/02*** | (2006.01) |

(52) U.S. Cl.

CPC ..... *F23L 17/02* (2013.01); *F23L 2700/001* (2013.01)

(58) Field of Classification Search

CPC ..... F23J 13/08; F23L 17/02; F23L 2700/001
USPC ..... 454/4
IPC ..... F23J 13/08
See application file for complete search history.

(56) References Cited

U.S. PATENT DOCUMENTS

| | | | | |
|---|---|---|---|---|
| 421,098 | A * | 2/1890 | Harrington | 454/4 |
| 1,483,784 | A * | 2/1924 | Collver | 454/4 |
| 1,955,176 | A * | 4/1934 | Dearing | 454/37 |

(Continued)

FOREIGN PATENT DOCUMENTS

| | | | |
|---|---|---|---|
| CA | 2448369 A1 * | 5/2004 | |
| DE | 3929578 A * | 3/1991 | |

(Continued)

OTHER PUBLICATIONS

Cuilian, CN202328297U English abstract, Jul. 11, 2012.*

(Continued)

*Primary Examiner* — Alissa Tompkins
*Assistant Examiner* — Phillip E Decker
(74) *Attorney, Agent, or Firm* — David A. Guerra

(57) ABSTRACT

The invention consists in a cover for a chimney, the cover comprising: a housing adapted to surround at least an upper end of a chimney, the housing having an expansion area for receiving emissions from the upper end of the chimney; a diffuser for diffusing the emissions from the upper end of the chimney into the expansion area; at least one air inlet for introducing air into the expansion chamber; at least one outlet for enabling air or emissions to be exhausted from the expansion chamber; wherein the housing is adapted such that emissions exiting the upper end of the chimney are diffused and expanded into the expansion chamber and a reduced pressure is created within the housing for drawing emissions from the upper end of the chimney into the expansion chamber.

20 Claims, 4 Drawing Sheets

(56) References Cited

U.S. PATENT DOCUMENTS

| | | | | | |
|---|---|---|---|---|---|
| 1,966,620 | A | * | 7/1934 | Fluor, Jr. | 454/906 |
| 2,213,386 | A | * | 9/1940 | Davis et al. | 126/47 |
| 2,269,050 | A | * | 1/1942 | Zimmerman | 454/39 |
| 2,535,796 | A | * | 12/1950 | Hickman | 417/154 |
| 2,687,127 | A | * | 8/1954 | Leffler | 454/43 |
| 2,856,837 | A | * | 10/1958 | Thulman | 454/37 |
| 3,461,915 | A | | 8/1969 | Hartmann et al. | |
| 3,874,363 | A | * | 4/1975 | Biedenbender et al. | 454/4 |
| 4,106,290 | A | * | 8/1978 | Johnson | 454/4 |
| 4,211,155 | A | | 7/1980 | Stoll et al. | |
| 4,616,457 | A | * | 10/1986 | Yoder et al. | 52/218 |
| 4,655,913 | A | * | 4/1987 | Boersma | 210/163 |
| 4,759,272 | A | * | 7/1988 | Zaniewski | F23L 17/005 454/344 |
| 5,234,582 | A | * | 8/1993 | Savoie | 210/163 |
| 6,959,457 | B2 | * | 11/2005 | Hernandez | 454/4 |
| 6,997,798 | B2 | * | 2/2006 | Jensen | 454/4 |
| 7,014,555 | B1 | * | 3/2006 | Issod | 454/44 |
| 7,086,855 | B2 | * | 8/2006 | Brice et al. | 431/328 |
| 7,179,164 | B2 | * | 2/2007 | Arnold, Jr. | 454/12 |
| 2007/0202790 | A1 | | 8/2007 | Burns et al. | |
| 2009/0088060 | A1 | * | 4/2009 | Arnold et al. | 454/4 |

FOREIGN PATENT DOCUMENTS

| | | | | |
|---|---|---|---|---|
| EP | 0257636 | B2 | | 5/1996 |
| GB | 806711 | A | * | 12/1958 |
| JP | 2000-054688 | A | | 2/2000 |
| JP | 2000-054689 | A | | 2/2000 |
| SU | 1795224 | A1 | | 2/1993 |
| WO | WO-85/03993 | A1 | * | 9/1985 |
| WO | WO 2005/008131 | A1 | * | 1/2005 |

OTHER PUBLICATIONS

Merker, et al, DE 3929578 A English machine translation, Mar. 7, 1991.*

Definition of "Adjacent", Oxford English Dictionary, Oxford University Press, 2015.*

* cited by examiner

COVER FOR A CHIMNEY

CROSS-REFERENCE TO RELATED APPLICATIONS

This application is an U.S. national phase application under 35 U.S.C. §371 based upon co-pending International Application No. PCT/NZ2009/000143 filed on Jul. 16, 2009. Additionally, this U.S. national phase application claims the benefit of priority of co-pending International Application No. PCT/NZ2009/000143 filed on Jul. 16, 2009, and New Zealand Application No. 569850 filed on Jul. 16, 2008. The entire disclosures of the prior applications are incorporated herein by reference. The international application was published on Jan. 21, 2010 under Publication No. WO 2010/008305.

FIELD OF THE INVENTION

This invention relates to a cover for a chimney.

BACKGROUND

Chimneys are used to vent flue gases and other emissions from fireplaces, furnaces, and low or high combustion chamber burners to the external environment. If there is enough wind, the flue gases and other emissions are blown away and diluted, and air pollution levels do not get too high. However, during still winter nights, there is often a temperature inversion. A temperature inversion traps smoke close to the ground causing higher levels of air pollution.

Many conventional low or high combustion chamber burners, fireplaces, furnaces, and wood burners do not burn fuel efficiently or completely. The unburnt emissions add to the amount of emissions from the chimney flue and contribute to air pollution.

A problem with many existing chimneys is that atmospheric pressure resists the flow of flue gases and emissions from the fireplace through to the upper end of the chimney. The atmospheric pressure typically creates a resistance pressure of about 14 psi within the chimney flue. This resistance can be increased by wind pressure and/or low atmospheric pressure. Wind creates a backpressure within the chimney flue. This backpressure can cause flue gases and emissions to escape from the fireplace into the room, for example when the door of a wood burner is opened.

The resistance can also cause carbon to be deposited inside the chimney flue. The carbon deposits create additional resistance against the flow of flue gases and emissions through the chimney flue. In addition, the carbon absorbs water, for example overnight, which adds to the amount of emissions from the chimney flue.

A variety of chimney covers or cowls are available for use with existing chimneys. In a typical cowl, the flue gases and emissions are forced to change direction within the cowl before they are emitted to the external environment. Changing direction adds to the resistance of the exhaust gases in the chimney flue.

The resistance provided by the downdraft, carbon deposits, and the cowl reduces the efficiency of the fireplace and chimney and increases the amount of unburnt emissions from the chimney flue.

It is an object of at least preferred embodiments of the present invention to provide a cover for a chimney to create a reduced pressure in a chimney flue and thereby reduce emissions from the chimney flue, or to at least provide the public with a useful alternative.

SUMMARY OF THE INVENTION

The term "comprising" as used in this specification means "consisting at least in part of"; that is to say when interpreting statements in this specification which include "comprising", the features prefaced by this term in each statement all need to be present but other features can also be present. Related terms such as "comprise" and "comprised" are to be interpreted in a similar manner.

In a first aspect, the invention broadly consists in a cover for a chimney, the cover comprising:

- a housing adapted to surround at least an upper end of a chimney, the housing having an expansion area for receiving emissions from the upper end of the chimney;
- a diffuser for diffusing the emissions from the upper end of the chimney into the expansion area;
- at least one air inlet for introducing air into the expansion chamber;
- at least one outlet for enabling air or emissions to be exhausted from the expansion chamber;
- wherein the housing is adapted such that emissions exiting the upper end of the chimney are diffused and expanded into the expansion chamber and a reduced pressure is created within the housing for drawing emissions from the upper end of the chimney into the expansion chamber.

The emissions may be flue gases from a low or high combustion chamber burner, fireplace, furnace, or wood burner. The emissions may also contain uncombusted combustible material.

Preferably, the housing is adapted such that the reduced pressure within the housing draws air from the at least one air inlet into the expansion chamber.

Preferably, the diffuser comprises a diffuser cone.

Preferably, the housing is attachable to a roof of a building. The housing preferably surrounds the portion of the chimney from the roof to the upper end of the chimney.

Preferably, the expansion area extends upwardly from the upper end of the chimney. The expansion area suitably has a greater cross section than the cross section of the existing chimney.

Preferably, the at least one air inlet is defined by one or more internal surfaces of the housing. Alternatively, the at least one air inlet may be a conduit or pipe for introducing air into the expansion chamber. In a preferred embodiment, the cover comprises four air inlets for introducing air into the expansion chamber.

Preferably, the housing is formed as a sleeve having a lower end and an upper end. Preferably, the cover further comprises a grill extending over the upper end of the sleeve. The grill preferably provides a backpressure to the expansion area. The grill is preferably a generally planar component with a plurality of apertures. In a preferred embodiment, the apertures are formed towards the edges of the plate with a central portion of the plate being solid free of apertures.

Preferably, the housing has a substantially tetragonal cross section with four walls and four corners. More preferably, the housing has a substantially square cross section. In a preferred embodiment, the four inlets are defined by the four corners of the sleeve.

The existing chimney preferably has a substantially circular cross section. The housing is preferably sized such that each of the four walls engages against, or are positioned in close proximity to, the existing chimney when the cover is installed on the existing chimney.

In accordance with a second aspect of the present invention, there is provided the combination of a cover for a chimney as outlined above and a chimney.

Preferably, the housing surrounds the portion of the chimney from the roof to the upper end of the chimney.

Preferably, the expansion area has a greater cross section than the cross section of the existing chimney.

The cover for a chimney may have been retrofitted to the chimney. Alternatively, the cover may be integral with the chimney.

The second aspect may include one or more of the features of the first aspect.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting. Where specific integers are mentioned herein which have known equivalents in the art to which this invention relates, such known equivalents are deemed to be incorporated herein as if individually set forth.

As used herein the term "(s)" following a noun means the plural and/or singular form of that noun.

As used herein the term "and/or" means "and" or "or", or where the context allows both.

The invention consists in the foregoing and also envisages constructions of which the following gives examples only.

BRIEF DESCRIPTION OF THE DRAWINGS

The present invention will now be described with reference to the accompanying drawings in which.

DETAILED DESCRIPTION OF PREFERRED EMBODIMENT

Figure 1:
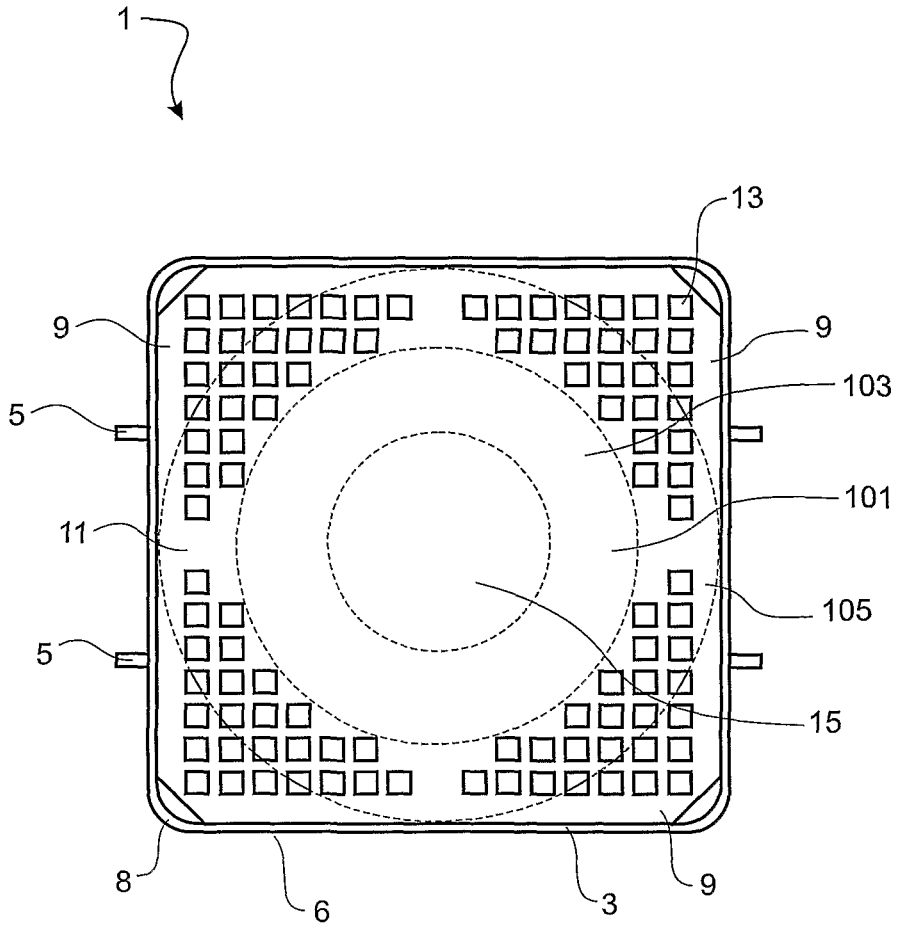
FIG. 1 is a top view of a first preferred embodiment cover for a chimney installed on an existing chimney on a building.
Figure 2:
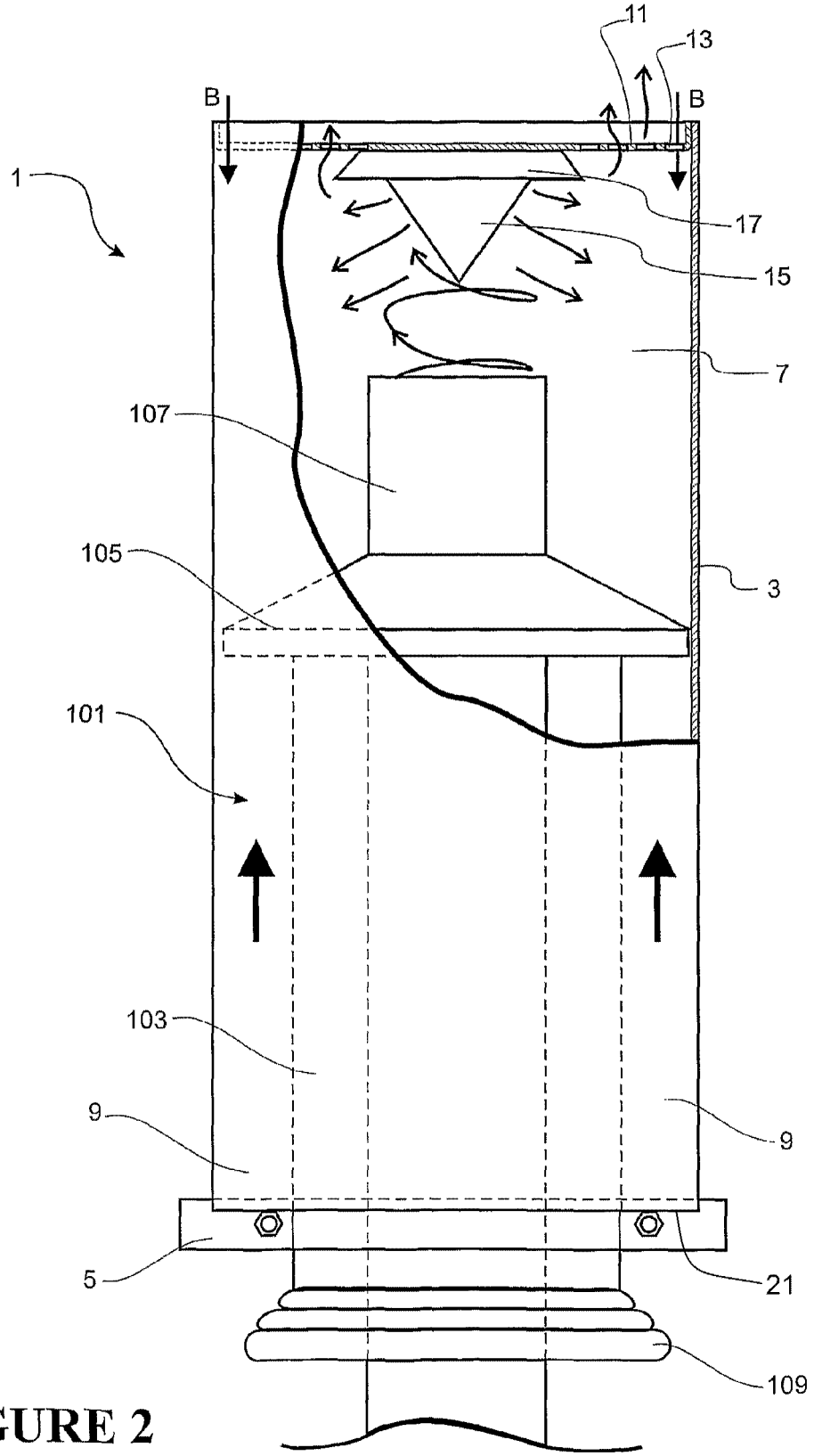
FIG. 2 is a side view of the first preferred embodiment cover for a chimney of FIG. 1 with a cutaway section showing the interior of the cover and the existing chimney.

Referring to FIGS. 1 and 2, a first preferred embodiment cover 1 is shown installed on an existing chimney 101. The chimney may be a chimney for a low or high combustion chamber burners, fireplace, furnace, or wood burner. The existing chimney has a casing 103, a cover 105, and a flue 107. The existing casing typically has a flexible flashing 109 for connecting the casing to a roof of a building. Each of the casing 103, the cover 105, and the flue 107 has a substantially circular cross section.

The cover 1 has a housing 3 that surrounds the upper end of the existing chimney 101. When installed on an existing chimney, the cover 1 is attached at or near the bottom of the existing chimney and extends upwards to surround the upper end of the existing chimney. The cover 1 is attached to the existing chimney by four brackets 5.

The housing 3 has an expansion area 7 for receiving emissions from the upper end of the existing chimney 101. When the cover 1 is installed on the chimney, the expansion area 7 extends upwardly from the upper end of the chimney. The cross section of the expansion area 7 is greater than the cross section of the existing chimney flue 107.

With reference to FIGS. 1 and 2, the housing 3 has four side walls 6 and four corners 8. The housing 3 has a substantially square transverse cross section and is substantially rectangular when viewed from the side. The housing is sized such that each of the four walls engages against, or are positioned in close proximity to, the existing chimney when the cover is installed on the existing chimney. It will be appreciated that the dimensions of the housing may be chosen or designed depending on the dimensions of the existing chimney. With reference to FIG. 2, four airways 9 are formed in the corners of the housing 3 between the housing and the outer surface of the casing 103, the cover 105, and the flue 107 of the existing chimney. The airways 9 extend from the lower portion of the housing up to the expansion area 7 and introduce fresh air from outside the cover to the expansion area.

With reference to FIG. 2, the cover 1 also has a grill 11 covering the outlet. The grill has a plurality of apertures 13 in each corner. The grill 11 inhibits rain water, dirt, birds or other small animals from entering the cover 1 and the existing chimney flue 107. The grill 11 also preferably provides a backpressure to the expansion area 7. The apertures 13 are formed towards the edges of the grill with the central portion of the plate being free of apertures. In one embodiment, the total area of the apertures is about 2.5 times the area of the existing flue 107. However, it will be appreciated that the ratio may be altered. It will be appreciated that the dimensions of the apertures may be chosen or designed depending on the dimensions or area of the existing flue. For example, for use on a larger chimney, the apertures of the grill will be larger.

The cover also has a diffuser cone 15. When installed, the diffuser cone 15 is positioned above the upper end of the existing chimney flue 107 and above the expansion area 7. The diffuser cone 15 is attached to the grill 11 and extends from the grill towards the expansion area. The diffuser cone 15 preferably has a rain flashing 17. The rain flashing is an annular component having an angled side wall. The side wall extends downwardly and outwardly from the cone towards the expansion chamber.

The housing 3 is preferably formed by bending stainless steel into the required shape. Accordingly, the housing will have radiused corners 8. The housing shown in the drawings is for use on a generally flat roof. Accordingly, the housing has a generally horizontal lower edge 21. Alternatively, the chimney cover may be used on a roof having an angled or curved profile. The lower edge of the housing may be shaped to correspond to the profile of the roof.

The grill 11 is footed from sheet metal. The apertures are preferably punched or cut into the sheet material during manufacturing. Alternatively, the grill 11 may be a cast or forged components and the apertures may be formed as part of the casting process.

The components of the cover are preferably formed as separate components and then welded together. Alternatively, some of the components may be integrally formed with each other. For example, the grill may be integrally formed with the housing.

In the preferred embodiments, each of the components of the chimney cover 1 is formed from stainless steel. Alternatively, the components may be formed from any other suitable metal such as mild steel or an Aluminium alloy, for example. The components may be galvanized or painted to inhibit corrosion or for aesthetic purposes.

The flow of exhaust gases and other emissions from the upper end of the chimney through the cover and out to the external environment as shown by the arrows in FIG. 2. The emissions will contain flue gases and uncombusted combustible material. The exhaust gases and other emissions from the existing chimney will be emitted from the upper end of the chimney. As the emissions leave the existing chimney, they will strike the diffuser cone 15 and be diffused into the expansion chamber 7. The angle of the diffuser cone causes emissions from the existing chimney to deflect at about 90 degrees from the original direction of travel.

The exhaust gases will expand and diffuse in the expansion chamber 7. It is understood that as the gases expand in the expansion chamber, they will reduce in pressure. The reduced pressure that is created in the housing will draw or pill fresh air from the airways 9 into the expansion chamber. The reduced pressure in the housing will also draw or pull more exhaust gases and emissions from the existing flue 107 into the combustion area. The operation of the chimney cover is self-regulating and will draw or pull in additional air from the airways 9 as air is required.

The reduced pressure in the housing is lower than the pressure at the lower end of the flue. The reduced pressure is also lower than the atmospheric pressure outside the housing.

Combustion may occur in the expansion chamber 7 when the temperature in the expansion chamber reaches an ignition temperature of the uncombusted emissions and when fresh air is supplied to the combustion area. Additionally or alternatively, combustion may occur above the grill. Carbon has an ignition temperature of about 400° C. Accordingly, the uncombusted carbon contained in the emissions will combust when the temperature is at or above about 400° C., for example. Preferably, the emissions are at or above ignition temperature in the existing flue 107. When the fresh air is drawn in from the lower corners of the housing 9, the uncombusted emissions will combust.

A vortex or circular motion is created in the expansion chamber 7 as the exhaust gases and emissions are drawn or pulled through the flue of the existing chimney flue 107. The vortex creates voids or areas of reduced pressure above the grill. The voids are created above the corners of the housing. The voids create a small back pressure that draws or pulls external air above the grill 11 into the expansion chamber and acts against the exhaust gases leaving the expansion chamber. It has been noticed that in use, the corners of the grill are cooler than other parts of the housing. The external air being drawn or pulled into the expansion chamber is indicated by arrows labelled B in FIG. 2. The external air mixes with the exhaust gases and emissions within the expansion chamber 7. The back pressure compresses the exhaust gases and emissions in the expansion chamber. The back pressure keeps the exhaust gases and emissions in the expansion chamber for at least a sufficient time for any uncombusted emissions to combust before they are exhausted from the expansion chamber through the grill 11. The exhaust gases and emissions will be expelled from the cover through the grill. The emissions will leave the grill in an upwards and circular direction because of the vortex formed in the expansion chamber 7.

It is believed that when the cover is earthed, the cover reduces the emissions further compared to when the cover is not earthed. The cover can be earthed when the cover is used on a concrete chimney, a brick chimney, a chimney with metal flashing, in combination with a wet back, or when there is a water pipe running through the roof, for example. It is thought that the rapid burn of the emissions gives the emissions an electrostatic charge and the grill repels the charged emissions which may be burnt after they pass through the grill.

Figure 3:
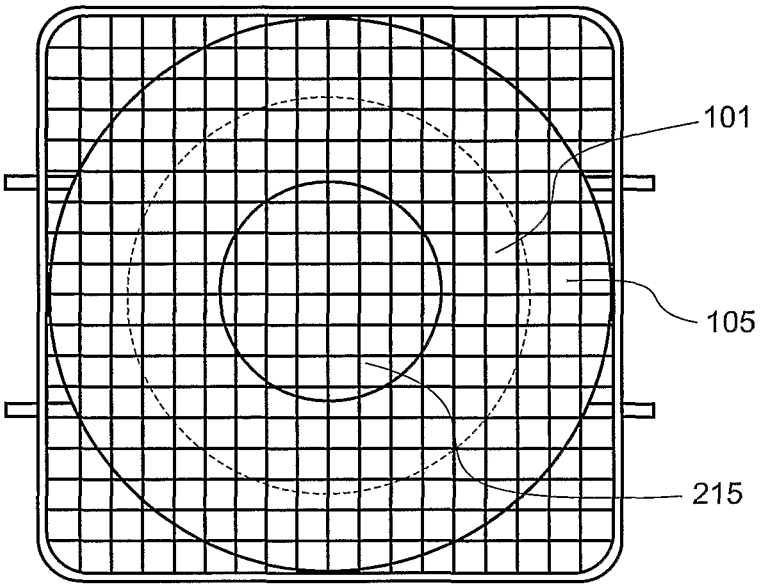
FIG. 3 is a top view of a second preferred embodiment cover for a chimney installed on an existing chimney on a building.
Figure 4:
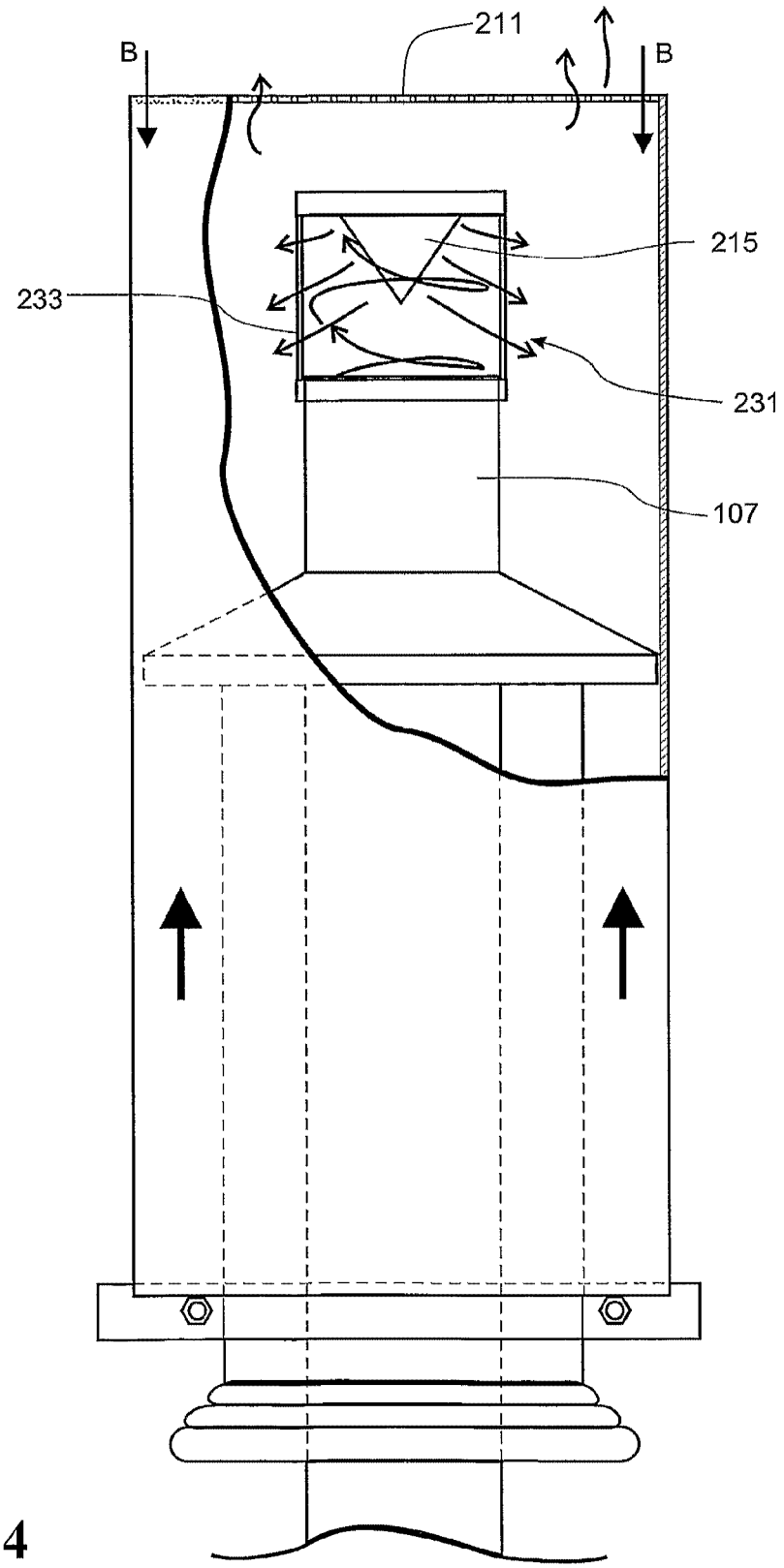
FIG. 4 is a side view of the second preferred embodiment cover for a chimney of FIG. 4 with a cutaway section showing the interior of the cover and the existing chimney.

Referring to FIGS. 3 and 4, a second preferred embodiment cover 1 is shown installed on an existing chimney 101. Unless described below, the features and operation should be considered to be the same as those described above for the first embodiment. Like numbers are used to indicated like parts with the addition of 200.

The second embodiment differs from the first embodiment in that the diffuser cone 215 is not attached to the grill 211. In the second preferred embodiment, the diffuser cone 215 is attached to the existing chimney flue by a support structure 231. In the preferred embodiment shown, the support structure 231 comprises arms 233 that support the cone above the upper end of the chimney. Alternatively, the support structure may comprise members that connect the cone to the housing or the grill, for example.

The second embodiment also differs from the first embodiment in that the grill is formed from a sheet of mesh, rather than from a sheet of material with punched or cut holes.

When the first or second preferred embodiment cover 1 is used with a chimney, the pressure within the existing chimney flue will be reduced. The amount of uncombusted emissions will also be reduced compared to a chimney without the cover. Using the first or second preferred embodiment cover on a chimney increases the efficiency of a fireplace and chimney. Less wood is needed using the cover on a chimney compared to a chimney without the cover. In addition, the preferred embodiment cover reduces emissions within about 6 minutes from when the fire is started.

When the first or second preferred embodiment cover 1 is used with a chimney, the improved efficiency means that a wetback hot water system may be connected to the chimney.

Preferred embodiments of the invention have been described by way of example only and modifications may be made thereto without departing from the scope of the invention.

For example, the preferred embodiment described is a cover for pre existing chimneys that can be retrofitted to existing chimneys. However, the cover may be formed as part of a chimney before it is installed on a building.

In the preferred embodiments described, the cover has a substantially square cross section. Alternatively, the cover may have any other suitable cross section, such as rectangular or substantially circular, for example.

In the preferred embodiments described, the airways are formed in the corners of the housing. Alternatively, the airways may be pre-formed in the cover. For example, the cover may be provided with ducts or pipes to introduce air to the expansion chamber.

The cover may be used with existing chimney flues that are not circular in cross section. For example, the cover may be used with an existing chimney flue that has a square or rectangular cross section.

It will be appreciated that the dimensions of the cover, including the housing and the grill apertures may be chosen or designed depending on the dimensions or area of the existing flue.

What I claim is:

1. A cover for a chimney, said cover comprising:

a housing adapted to surround at least an upper end of a chimney, said chimney having a substantially circular cross section, said housing having an expansion area for receiving emissions from an upper end of said chimney, said housing having a substantially tetragonal cross section with four walls and four corners;

a grill extending over an upper end of said housing;

a rain flashing extending from said grill, said rain flashing including an annular component having an angled side wall which extends downwardly and outwardly from said grill towards said expansion area;

a diffuser cone for diffusing the emissions from said upper end of said chimney into said expansion area, said diffuser cone extending downwardly and converging from said rain flashing towards said expansion area;

at least one air inlet for introducing air into said expansion area;

at least one outlet for enabling the air or emissions to be exhausted from said expansion area;

a casing received in said housing and surrounding a portion of said chimney featuring said upper end;

a casing cover received in said housing and over said upper end, said casing cover having a diameter greater than a diameter of said casing; and a flue extending from said casing cover into said expansion area, said flue having a diameter less than said diameter of said casing;

wherein said housing is adapted such that the emissions exiting said upper end of said chimney are diffused and expanded into said expansion area and a reduced pressure is created within said housing expansion area for drawing the emissions from said upper end of said chimney into said expansion area;

wherein said housing being sized such that each of said four walls are adjacent to a peripheral edge of said casing cover defining airways with said four corners between said housing and said casing cover, said airways extending from a lower portion of said housing up to said expansion area, said airways being in communication with said air inlet to introduce the air from outside said cover to said expansion area.

2. The cover as claimed in claim 1, wherein said housing is adapted such that said reduced pressure within said housing draws the air from said at least one air inlet into said expansion area.

3. The cover as claimed in claim 2, wherein said housing is attachable to at least one of a roof of a building, and said chimney.

4. The cover as claimed in claim 3, wherein said expansion area is adapted to extend upwardly from said upper end of said chimney.

5. The cover as claimed in claim 4, wherein said at least one air inlet is defined by one or more internal surfaces of said housing.

6. The cover as claimed in claim 4, wherein said at least one air inlet is a conduit or pipe for introducing the air into said expansion area.

7. The cover as claimed in claim 4, wherein said housing is formed as a sleeve having a lower end and an upper end.

8. The cover as claimed in claim 7, wherein said grill is adapted to provide a backpressure to said expansion area.

9. The cover as claimed in claim 8, wherein said grill is a planar component with a plurality of apertures.

10. The cover as claimed in claim 9, wherein apertures of said grill has a total area of 2.5 times an area of said upper end of said chimney.

11. The cover as claimed in claim 9, wherein said apertures are formed towards edges of said grill with a central portion of said grill being solid and free of apertures.

12. The cover as claimed in claim 11, wherein said rain flashing extends from said central portion of said grill.

13. The cover as claimed in claim 1, wherein said chimney being configured to produce a vortex in said expansion area of the emissions exiting said upper end of said chimney, and wherein said corners of said housing being configured to create areas of low pressure thereabove.

14. The cover as claimed in claim 1, wherein said casing cover has a converging conical configuration extending away from said casing toward said upper end of said housing, said flue extends from a converged open end of said casing cover.

15. A chimney cover system comprising:

a chimney having at least an upper end, and a substantially circular cross section; and a cover configured to receive at least said upper end of said chimney, said cover comprising:

a housing adapted to surround at least an upper end of said chimney, said housing having an expansion area for receiving emissions from an upper end of said chimney, said housing having a substantially tetragonal cross section with four walls and four corners;

a diffuser for diffusing the emissions from said upper end of said chimney into said expansion area;

at least one air inlet for introducing air into said expansion area;

at least one outlet for enabling the air or emissions to be exhausted from said expansion area;

a grill extending over an upper end of said housing, said grill having a planar component with a plurality of apertures defined towards edges of said grill with a central portion of said grill being solid and free of said apertures;

a casing received in said housing and surrounding a portion of said chimney featuring said upper end;

a casing cover received in said housing and over said upper end, said casing cover having a diameter greater than a diameter of said casing; and a flue extending from said casing cover into said expansion area, said flue having a diameter less than said diameter of said casing;

wherein said housing is adapted such that the emissions exiting said upper end of said chimney are diffused and expanded into said expansion area and a reduced pressure is created within said housing for drawing the emissions from said upper end of said chimney into said expansion area;

wherein said housing being sized such that each of said four walls are adjacent to a peripheral edge of said casing cover defining airways with said four corners between said housing and said casing cover, said airways extending from a lower portion of said housing up to said expansion area, said airways being in communication with said air inlet to introduce the air from outside said cover to said expansion area.

16. The chimney cover system as claimed in claim 15, wherein said housing surrounds a portion of said chimney from a roof to said upper end of said chimney.

17. The chimney cover system as claimed in claim 16, wherein said expansion area has a greater cross section than a cross section of said chimney.

18. The chimney cover system as claimed in claim 15 further comprising a rain flashing extending from said central portion of said grill, said rain flashing including an annular component having an angled side wall which extends downwardly and outwardly from said grill towards said expansion area.

19. The chimney cover system as claimed in claim 18, wherein said diffuser is a cone that extends downwardly and converging from said rain flashing towards said expansion area.

20. The chimney cover system as claimed in claim 15, wherein said casing cover has a converging conical configuration extending away from said casing toward said upper end of said housing, said flue extends from a converged open end of said casing cover.

* * * * *